United States Patent [19]

Prouvost

[11] 4,094,109

[45] June 13, 1978

[54] CONSTRUCTION OF HOUSES OR SIMILAR BUILDINGS BY MEANS OF AN INFLATABLE STRUCTURE

[76] Inventor: François Prouvost, 53, av. Montaigne, Paris, France, 75008

[21] Appl. No.: 770,848

[22] Filed: Feb. 22, 1977

[51] Int. Cl.[2] ..... E04B 1/34

[52] U.S. Cl. ..... 52/2; 249/65

[58] Field of Search ..... 52/2; 264/32; 249/65

[56] References Cited

U.S. PATENT DOCUMENTS

| | | | |
|---|---|---|---|
| 2,335,300 | 11/1943 | Neff | 52/2 |
| 2,976,875 | 3/1961 | Hoffman | 52/2 |
| 3,054,124 | 9/1962 | Silverstone | 52/2 |

*Primary Examiner*—J. Karl Bell

*Attorney, Agent, or Firm*—John J. Dennemeyer

[57] ABSTRACT

An inflatable support structure for the construction of houses or similar buildings has an envelope formed by an upper membrane and a lower membrane connected hermetically to each other to form a first pressure chamber constituting this envelope, and a second pressure chamber fixed to the basis of the first pressure chamber. Both pressure chambers are inflated to different pressures wherein the first pressure chamber is always inflated to a lower pressure than the second pressure chamber.

11 Claims, 1 Drawing Figure

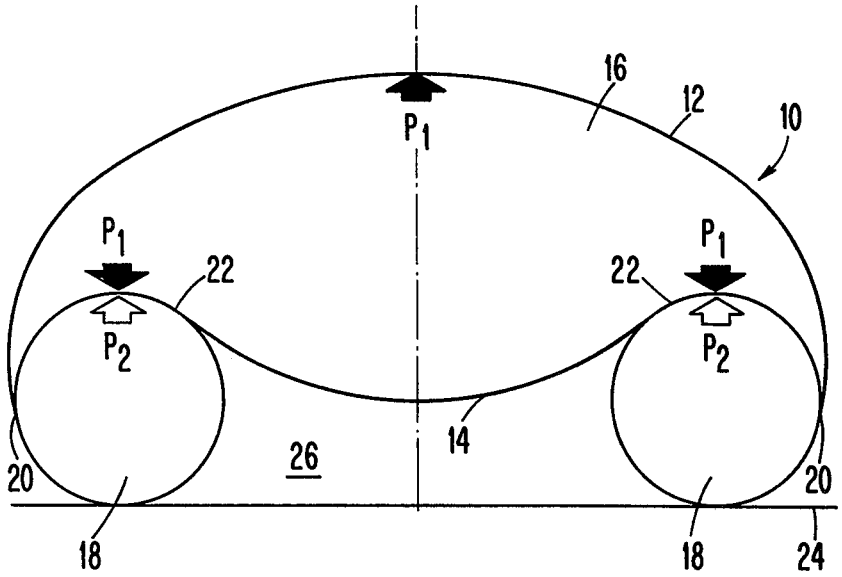
16
12
10
P1
P1
P1
22
22
P2
P2
14
26
20
20
18
18
24

CONSTRUCTION OF HOUSES OR SIMILAR BUILDINGS BY MEANS OF AN INFLATABLE STRUCTURE

BACKGROUND OF THE INVENTION

1. Field of the Invention

The invention concerns an inflatable support structure for the construction of houses or similar buildings.

2. Description of the Prior Art

In constructing houses or similar buildings it is known to use framings for the concrete. Different types of framings are used for casting concrete.

A particular method of construction consists in the utilization of the spraying of cement, plaster, concrete or similar materials according to the Torcet-system onto a support structure to form the walls and the roof of the house or the building to be constructed. It has been proposed to use as support structure for this method an inflatable structure, a kind of envelope anchored to the ground on which the materials used for the construction are sprayed according to the Torcet-system. However, the anchoring of the inflatable structure constitutes a big disadvantage and limits the mobility and use of this method of construction.

SUMMARY OF THE INVENTION

The object of the present invention is to provide for the construction of houses or similar buildings an inflatable support structure which does not have the disadvantages of the known structures of the same type and which constitutes a stable framing that does not require any anchoring to the ground and which is therefore very variable in its utilization.

According to the invention this object is achieved in that the inflatable support structure comprises an upper membrane and a lower membrane hermetically fixed to each other to form a first inflatable pressure chamber constituting the inflatable envelope, a second inflatable pressure chamber fixed to the base of the first pressure chamber, the pressure chambers being formed of a material enabling their utilization as support and framing in constructing houses or similar buildings from concrete or similar or analogous materials, and in that the first pressure chamber is inflated to a pressure lower than that of the second pressure chamber.

The second pressure chamber may advantageously be arranged below the first pressure chamber and/or at the periphery thereof.

The pressure chambers may be fixed to each other by welding. The upper membrane may be welded to the second pressure chamber and the lower membrane may also be welded to the second pressure chamber. The upper membrane may be fixed to the second pressure chamber along a first fixing line or zone, the lower membrane may be fixed to the second pressure chamber along a second fixing line or zone at a predetermined distance from the first fixing line or zone, and the dimension of the upper membrane between its fixing lines or zones is larger than the dimension of the lower membrane between its fixing lines or zones.

According to a preferred embodiment of the invention the upper and lower membranes may have a substantially circular shape and the second pressure chamber may have the form of a circular hose having a circular cross-section. The shape of the membranes may be triangular, quadrilateral or polygonal. The second pressure chamber may have an annular shape similar to the shape of the first pressure chamber.

The invention will now be described with reference to the accompanying drawing.

BRIEF DESCRIPTION OF THE DRAWING

The FIGURE is a cross-section of an inflatable support structure according to a preferred embodiment of the instant invention.

DETAILED DESCRIPTION OF THE PREFERRED EMBODIMENT

In the single FIGURE of the drawing an inflatable support structure 10 comprises an upper membrane 12 and a lower membrane 14 which are hermetically connected to one another to form a first pressure chamber 16. Means are provided to inflate the second pressure chamber 18 and to maintain it at the desired pressure. The second pressure chamber is arranged at the base of the first pressure chamber 16 and supports the same at its periphery. For this purpose the upper membrane 12 is connected to the second pressure chamber along a peripheral zone or line 20 and the lower membrane 14 is connected to the second pressure chamber 18 along a peripheral zone or line 22 to form the first pressure chamber 16.

The particular form of the pressure chambers 16 and 18 depends on the particular utilization thereof and does not form an essential feature of the invention, but it is selected as a function of the construction to be realized and besides the circular and oblong shapes the membranes may be polygonal or have any arbitrary geometrical form.

The material utilized for preparing the pressure chambers is not critical. It is sufficient that the materials be adapted for utilization in constructing houses or similar buildings by using the spraying of cement, plaster, concrete or similar materials according to the Torcet-system, that means the membranes must resist the impact of these materials, support the load created by their accumulation on the structure and be easily separated from these materials after hardening.

The pressure chambers and the membrance may be fixed to each other by bonding, welding, etc. depending on the materials utilized for preparing the inflatable and supporting structure.

When constructing houses or similar buildings by using the inflatable support structure according to the invention, this structure is placed on the ground 24. The first pressure chamber 16 is then inflated to the desired pressure as is also the second pressure chamber 18. The first pressure chamber 16 is inflated to the pressure P1 and the second pressure chamber 18 is inflated to the pressure P2. The pressure P2 is always higher than the pressure P1. The fact of using different pressures in both pressure chambers 16 and 18 ensures a reciprocal stabilization of both the pneumatic systems each formed by one of the pressure chambers 16 and 18. The pressure P2 in the second pressure chamber 18 acts against the pressure P1 in the first pressure chamber and has a neutralization and stabilization effect so that the inflatable support structure according to the invention may be used without special anchoring to the ground. Thus the desired total mobility and liberty of action are obtained.

The inflatable structures having a single pressure chamber require anchoring on the ground due to their tendency to float on the ground. The addition of a second pressure chamber at the basis of the first pressure chamber creates, through the cooperation of both pressure chambers inflated to different pressures, a stabilizing force acting on the inflatable structure to stabilize the structure on the ground and to so avoid the necessity of anchoring the structure on the ground during utilization. The stabilizing effect of the stabilizing force is amplified if the fixing line or zone 20 of the upper membrane 12 to the second pressure chamber 18 is located at a certain distance from the fixing line or zone 22 of the lower membrane 14 to the second pressure chamber and if the dimension or area of the upper membrane between its fixing lines or zones 20 with the second pressure chamber 18 is larger than the dimension or area of the lower membrane 14 between its fixing lines or zones 22 with the second pressure chamber 18.

In the preferred embodiment of the inflatable and supporting structure according to the invention the upper and lower membranes 12, 14 have a substantially circular shape. The second pressure chamber 18 has the shape of a hose having a circular cross section and arranged to form an annulus.

In another preferred embodiment of the invention the inflatable and supporting structure consists of a first oblong elongated chamber 16 under which a second chamber having a similar shape is arranged so that this structure may be used to construct a tunnel.

The upper and lower membranes 12, 14 forming the first pressure chamber 16 may also have a substantially triangular, quadrilateral or polygonal shape, the second pressure chamber 18 having then a similar shape at the periphery of the first pressure chamber 16 with the second pressure chamber defining a space such as space 26.

In summary, the shape of the first pressure chamber 16 and of the second pressure chamber 18 is not an essential feature of the invention. A mixture of water and cement, plaster and/or a similar material and/or concrete is sprayed onto the supporting structure obtained by inflating the pressure chambers to different pressures until a layer of desired thickness is obtained. The layer so obtained is allowed to dry and the pressure chambers 16 and 18 of the inflatable support structure are deflated after hardening and the structure is removed. Depending on the support structure which has been utilized, a structure of cement, plaster and/or a similar material and/or concrete is obtained forming the roof and the walls of the house, when an inflatable support structure having a circular, triangular, quadrilateral or polygonal shape is used, or a tunnel, when an oblong inflatable support structure is used. Accordingly many structural shapes may be obtained using an inflatable support structure according to the invention having an appropriate shape.

It is obvious that means may be used on the inflatable structures where openings are desired in the building for windows, doors, ventilation or for grouping different rooms of a housing in order to avoid that the layer of cement, plaster, etc. is formed in these places. These means may be the frames of doors and windows which, after hardening of the sprayed layer, remain in the layer and are anchored therein. When constructing a house having several rooms, the same inflatable structure may be used for all rooms, or depending on the size and shape of the rooms, different structures may be used. The finished houses and buildings may be covered by means of soil to which a binder has been added; this forms a good insulation of the housing and adapts it to the environment.

The pressures utilized in both pressure chambers 16 and 18 are not critical, but the second pressure chamber 18 must always be inflated to a higher pressure than the first pressure chamber 16. The absolute value of the pressures used depends on the size of the pressure chambers 16 and 18 of the inflatable structure, the construction materials sprayed according to the Torcet-process on the structure to construct a house, the amount of water which has been used, the thickness of the sprayed layer, etc. These values can be easily determined by tests. It has been found that for example a pressure of 500 $kg/m^2$ in the first pressure chamber 16 and 2500 $kg/m^2$ in the second pressure chamber 18 are satisfactory for a circular structure having a diameter of 7.5 meters when concrete is sprayed.

Although the invention has been shown and described with respect to a preferred embodiment thereof, it should be understood by those skilled in the art that various changes in the form and details thereof may be made without departing from the scope of the invention as defined in the following claims.

What is claimed is:

1. An inflatable support structure for constructing houses or similar buildings comprising an upper membrane and a lower membrane connected hermetically to each other along a peripheral zone thereof wherein the dimensions of the upper membrane are larger than the corresponding dimensions of the lower membrane and the upper and lower membranes form a first pressure chamber constituting an inflatable envelope, a second inflatable pressure chamber fixed to the basis of said first pressure chamber, said pressure chambers being formed of a suitable material for their utilization as support and framing in the construction of houses or similar buildings of concrete or similar or analogous materials, and wherein said first pressure chamber is inflated to a pressure lower than that of said second pressure chamber.

2. The structure according to claim 1, wherein said pressure chambers are connected to each other by welding.

3. The structure according to claim 2, wherein said upper membrane is hermetically fixed to said second pressure chamber and said lower membrane is hermetically fixed to said second pressure chamber to form said first pressure chamber.

4. The structure according to claim 3, wherein said upper membrane is fixed to said second pressure chamber along a first fixing line or zone, said lower membrane is fixed to said second pressure chamber along a second fixing line or zone located at a predetermined distance from said first fixing line or zone, and wherein the dimension of said upper membrane between its fixing lines or zones is larger than the dimension of said lower membrane between its fixing lines or zones.

5. The structure according to claim 3, wherein said second pressure chamber is fixed to the periphery of said first pressure chamber and defines an open space.

6. The structure according to claim 5, wherein said first pressure chamber is substantially circular and that said second pressure chamber is formed of a hose having a circular cross-section and arranged as an annulus.

7. The structure according to claim 5, wherein said first pressure chamber is oblong and said second pressure chamber is an oblong pressure chamber having the same length as said first pressure chamber.

8. An inflatable support structure for bearing a hardenable substance which forms a shell when cured, wherein the shell defines an enclosed space from which the support structure may be removed, said support structure comprising:

an upper membrane having an outside surface upon which the hardenable substance is deposited;

a lower membrane having an area less than that of the upper membrane;

means for connecting the upper and lower membranes along the peripheries thereof to define a first pressure chamber therebetween which when pressurized causes the upper membrane substantially to define the shape of the shell, and second hermetic chamber means attached to the first pressure chamber adjacent to the peripheries of the upper and lower membranes, said second pressure chamber means being inflatable to a pressure greater than that of the first pressure chamber to stablize the inflated structure on the surface upon which the structure rests.

9. The inflatable support structure of claim 8 wherein the means for connecting the upper and lower membranes forms a base of the upper chamber from which the second pressure chamber means is depended.

10. The inflatable support structure of claim 9 wherein the peripheries of the upper and lower membranes are welded to the base in spaced relation to one another.

11. The inflatable support structure of claim 9 wherein the second hermetic chamber is arranged to define an open space between portions thereof.

* * * * *